United States Patent [19]

Colapinto

[11] 4,305,331

[45] Dec. 15, 1981

[54] SHEET-FEEDING MECHANISM FOR FLAT-BED SCREEN PRINTER

[75] Inventor: Fabio Colapinto, Milan, Italy

[73] Assignee: The Argon Service Ltd. S.R.L., Milan, Italy

[21] Appl. No.: 142,984

[22] Filed: Apr. 23, 1980

[30] Foreign Application Priority Data

Apr. 24, 1979 [IT] Italy ..... 22118 A/79

[51] Int. Cl.[3] ..... B41F 1/36; B41F 21/05; B41L 13/00

[52] U.S. Cl. ..... 101/123; 101/126; 101/382 MV; 101/407 BP; 108/102; 118/236; 156/576; 198/695; 269/296; 271/204; 271/266; 271/277

[58] Field of Search ..... 101/123, 382 MV, 407 BP, 101/408, 126, 129

[56] References Cited

U.S. PATENT DOCUMENTS

| | | | |
|---|---|---|---|
| 2,689,411 | 9/1954 | Huck | 101/382 MV |
| 3,199,447 | 8/1965 | Jaffa | 101/123 |
| 3,215,071 | 11/1965 | Stillwell | 101/126 |

FOREIGN PATENT DOCUMENTS

| | | | |
|---|---|---|---|
| 628853 | 10/1961 | Canada | 101/407 R |

*Primary Examiner*—Clyde I. Coughenour
*Attorney, Agent, or Firm*—Karl F. Ross

[57] ABSTRACT

A screen printer has a flat bed coplanar with a loading and an unloading surface on opposite sides thereof, the bed being divided into a stationary middle section and two movable outer sections confronting one another along boundary lines paralleling the direction of movement of copy sheets from the loading surface to the unloading surface. Such movement is effected with the aid of a conveyor comprising two chains underneath the bed entraining sheet-gripping jaws through the gaps formed between these sections when they are transversely separated. The jaws are almost flush with the plane of the bed and the loading and unloading surfaces; upon closure of the bed sections, they are received in cutouts of the outer sections and are thus immobilized while a printing screen descends into contact with a copy sheet overlying the bed.

8 Claims, 8 Drawing Figures

SHEET-FEEDING MECHANISM FOR FLAT-BED SCREEN PRINTER

FIELD OF THE INVENTION

My present invention relates to a screen printer having a flat bed overlain by a screen holder which can be lowered onto a copy sheet on that bed for imprinting same.

BACKGROUND OF THE INVENTION

The feeding of copy sheets to the supporting surface of the bed is conventionally accomplished by grippers which seize the sheet and entrain it across the bed into printing position. The grippers must then be retracted relatively to the bed so as not to interfere with the lowering of the screen holder into its working position. For this purpose, either the sheet grippers or the bed must be vertically movable.

Aside from the need for providing a rather complex gripper drive or a separate drive for the printing bed, the relative vertical motion between the supporting surface of the bed and the grippers engaging a sheet edge tends to wrinkle or crease the sheet and to mar the appearance of its imprinted face.

OBJECT OF THE INVENTION

The object of my present invention, therefore, is to provide an improved screen printer which obviates this drawback.

SUMMARY OF THE INVENTION

In accordance with my present invention, the printing bed is divided into a plurality of relatively displaceable sections adjoining one another along boundaries which are parallel to the direction of entrainment of a sheet over a transport path including that bed. The overlying screen holder is alternately raised and lowered by operating means correlated with feed means for placing a sheet to be imprinted on the bed before each descent of the screen holder and thereafter removing the imprinted sheet, the operating means also serving to separate the bed sections upon a raising of the screen holder and to move these sections together upon a lowering of that holder so as to provide a continuous sheet-supporting surface. One or more sheet grippers, forming part of the feed means, pass substantially on the level of the bed between the separated sections thereof in a raised position of the screen holder.

The transport path may further include a loading surface and an unloading surface on opposite sides of the bed whose sections are shiftable in a common horizontal plane of these surfaces. The loading and unloading surfaces advantageously have slots in line with the section boundaries of the bed for receiving the sheet gripper or grippers before and after the printing operation.

In the preferred embodiment more particularly described hereinafter, the bed is divided into a stationary middle section and two transversely shiftable outer sections whose separation from the middle section forms two parallel gaps traversed by respective sheet grippers. I further prefer to provide the outer bed sections with respective cutouts which confront the middle section and accommodate the sheet grippers in a printing position when the sections are closely juxtaposed.

BRIEF DESCRIPTION OF THE DRAWING

The above and other features of the invention will now be described in detail with reference to the accompanying drawing in which.

and

Figure 8:
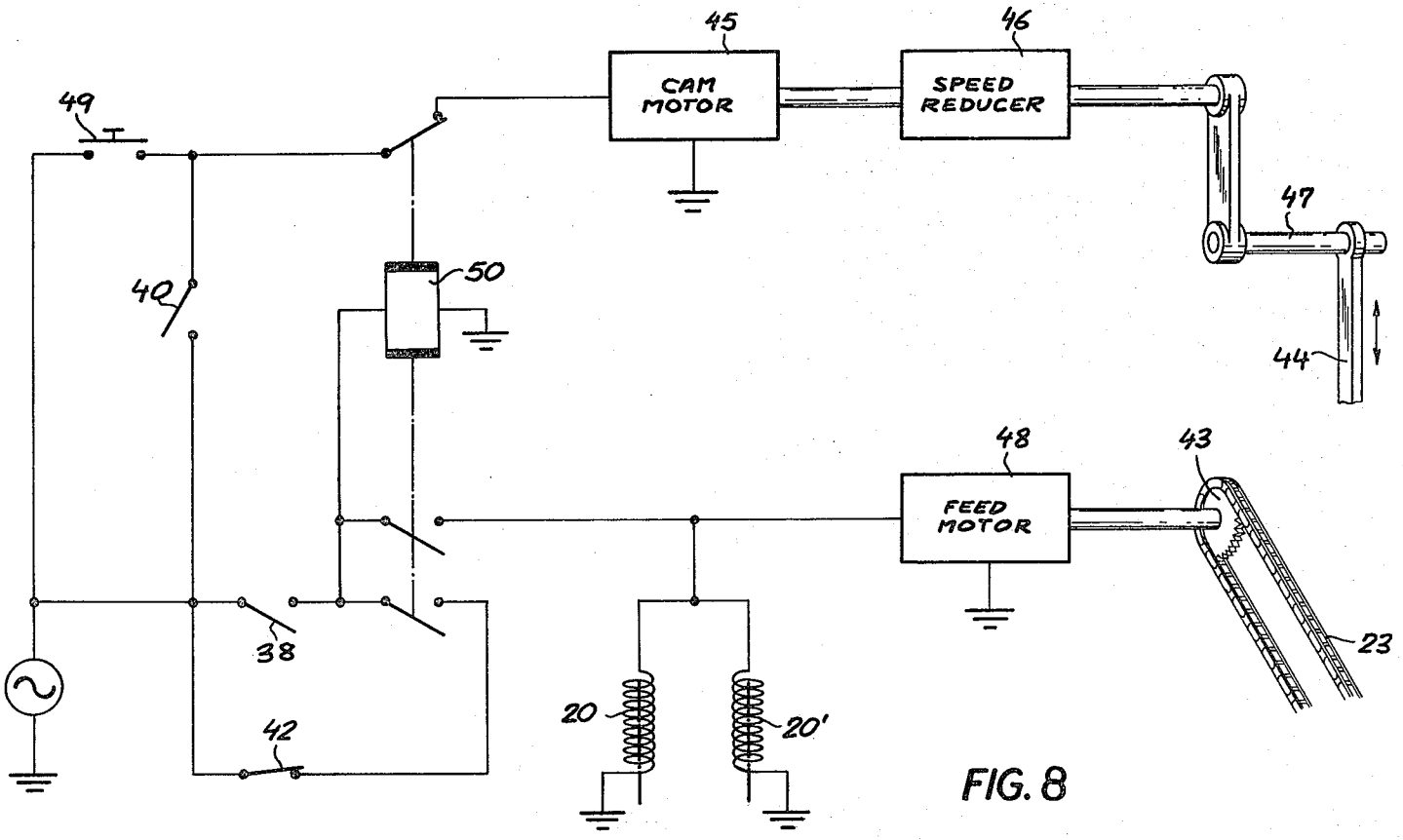

FIG. 8 shows an operating circuit for the screen printer.

SPECIFIC DESCRIPTION

In FIGS. 1–5 I have shown a printing device 1 with a base 2 including a prismatic frame 3 with an upper surface 3' overlain by a printing bed 4. The bed is split into three rectangular sections, i.e. a fixed middle section **4*b* and two transversely shiftable outer sections 4*a* and 4*c*, whose major sides are parallel to one another and to a transport path for sheets 8 to be imprinted. This transport path extends from a loading surface 6 on one side of bed 4 to an unloading surface 7 on the opposite side, the latter surface being constituted in this embodiment by the upper reaches of a set of conveyor belts with drive rollers on a common shaft 7'. A frame 5 supporting a printing screen 24 is vertically movable above bed 4 by means of four corner rods 5' that are slidably mounted in frame 3**.

Figure 5:
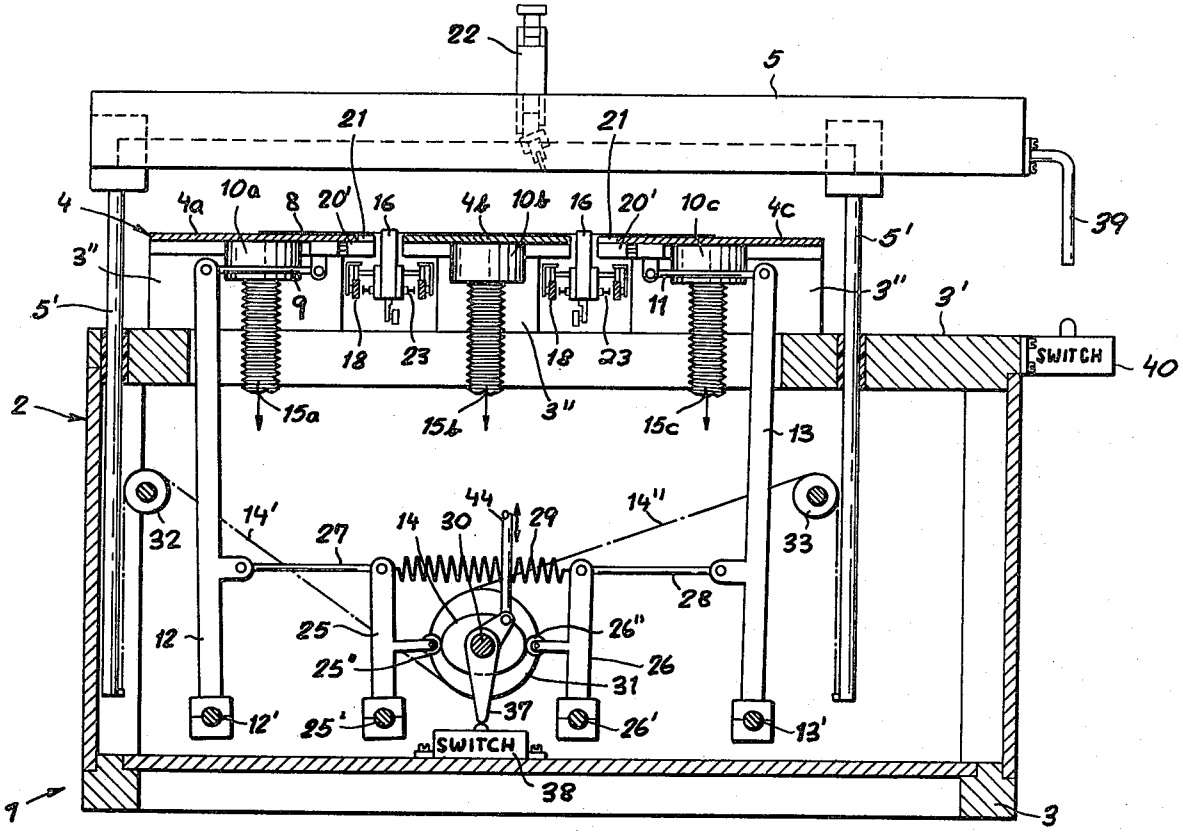
FIG. 5 is a cross-sectional view taken on the line V—V of FIG. 2.

The three bed sections **4*a*, 4*b* and 4*c* are perforated and provided with respective suction boxes 10*a*, 10*b* and 10*c*, shown in FIG. 5, which communicate via flexible conduits 15*a*, 15*b*, 15*c* with a nonillustrated suction pump designed to immobilize a sheet 8 in its printing position aligned with screen 24. The two outer sections 4*a* and 4*c* are slidably guided on mountings 3'', rising from the top 3' of frame 3, and are articulated (with the necessary play) to respective levers 12 and 13 with fixed fulcra 12' and 13' near the bottom of base 2. Ancillary levers 25 and 26 fulcrumed at 25' and 26' are linked with levers 12 and 13 by rods 27 and 28, levers 25 and 26 carrying cam followers 25'' and 26'' which bear under the tension of a spring 29 upon a cam disk 14 on a shaft 30. This shaft is also shown provided with a capstan 31 engaged by cables or chains 14' which pass around respective deflecting rollers 32, 33 inside the base and are tied to the lower ends of respective pairs of mounting rods 5' so as to elevate these rods, and with them the screen holder 5, when levers 12, 13 are cammed apart to separate the two outer bed sections 4*a* and 4*c* from the inner section 4*b***.

Upon such separation, two longitudinal gaps 19 appear in the bed 4 which are in line with respective slots 19' on loading surface 6 and 19'' on unloading surface 7;

in the illustrated embodiment, in which the latter surface is formed by closely spaced conveyor belts, slots 19' are constituted by larger spaces between three belt groups. These gaps and slots form two pathways for respective grippers 16, each pathway being flanked by a pair of tracks 18 in which the grippers are guided by rollers 17 that are journaled on axles 17' by means of ball bearings; see FIGS. 5–7. The guide tracks, illustrated only in part, form closed loops whose elongate upper reaches parallel the pathways 19, 19', 19'' and closely encompass two pairs of endless drive chains 23 engaged by sprockets 43 (see FIG. 8) at opposite ends of these loops. Each pair of tracks 18 supports a plurality of spaced-apart grippers 16 whose structure has been illustrated in FIGS. 6 and 7. A body 16'' of each gripper, carrying axles 17', has a slidable stem 16' which on the upper run of its path is urged downward by a spring 34 and terminates at its bottom in a roller 35 coacting with a stationary ramp 36. A jaw 16''' at the top of stem 16' is lifted, as indicated in phantom lines in FIG. 6, when the roller 35 ascends a rising portion of ramp 36 upon approaching the bed 4 along loading surface 6 or upon leaving the unloading surface 7.

As shown in FIGS. 1–4, grippers 6 are engageable by two pairs of solenoid-operated detents 20 and 20' respectively underlying the loading surface 6 and the sheet-supporting surface of bed 4 in order to index these grippers in an insertion position and in a printing position, respectively. In the insertion position the jaws 16''' are raised by ramps 36 to facilitate the introduction of an edge of a copy sheet 8 into the two grippers engaged by detents 20. As the grippers start moving toward the bed 4, their rollers 35 descend quickly so that their jaws are closed by the springs 34 in order to entrain the sheet 8 across the bed 4 whose sections are separated at that time. After an advance by a distance approximately equal to the length of bed 4 in the transport direction, the grippers are engaged by detents 20' in a position of alignment with respective cutouts 21 in bed sections **4*a* and 4*c*. The tops of stems 16', which upon closure of their jaws 16''' are almost level with the upper surface of the bed, are thus received in these cutouts as the split bed 4 is solidified by a shift of its outer sections 4*a* and 4*c* into close juxtaposition with the middle section 4*b*. This interfitting of grippers 16 and cutouts 21 further immobilizes the sheet against accidental displacement during the printing operation which, with the screen holder 5 lowered onto the bed, is performed in the usual manner with the aid of an ink applicator 22 (FIG. 5) sliding transversely to the direction of sheet motion on the screen-holding frame 5**.

While the cam shaft 30 could obviously be operated manually with the aid of a crank or the like, I have shown in FIG. 5 part of a reciprocating linkage 44 enabling it to be reciprocated through an arc of 90° by means of an electric motor 45 illustrated in FIG. 8. Motor 45 drives, via a speed reducer 46, a crank arm 47 articulated to linkage 44, the operation of this motor being controlled by a cam 37 on shaft 30 (FIG. 5) closing a switch 38 in the illustrated bed-splitting position as well as by another switch 40 which is opened by a lug 39 on screen holder 5 when the latter has descended into its working position. FIG. 8 also shows a feed motor 48 for the intermittent driving of transport chains 23 via their respective sprockets 43.

Figure 1:
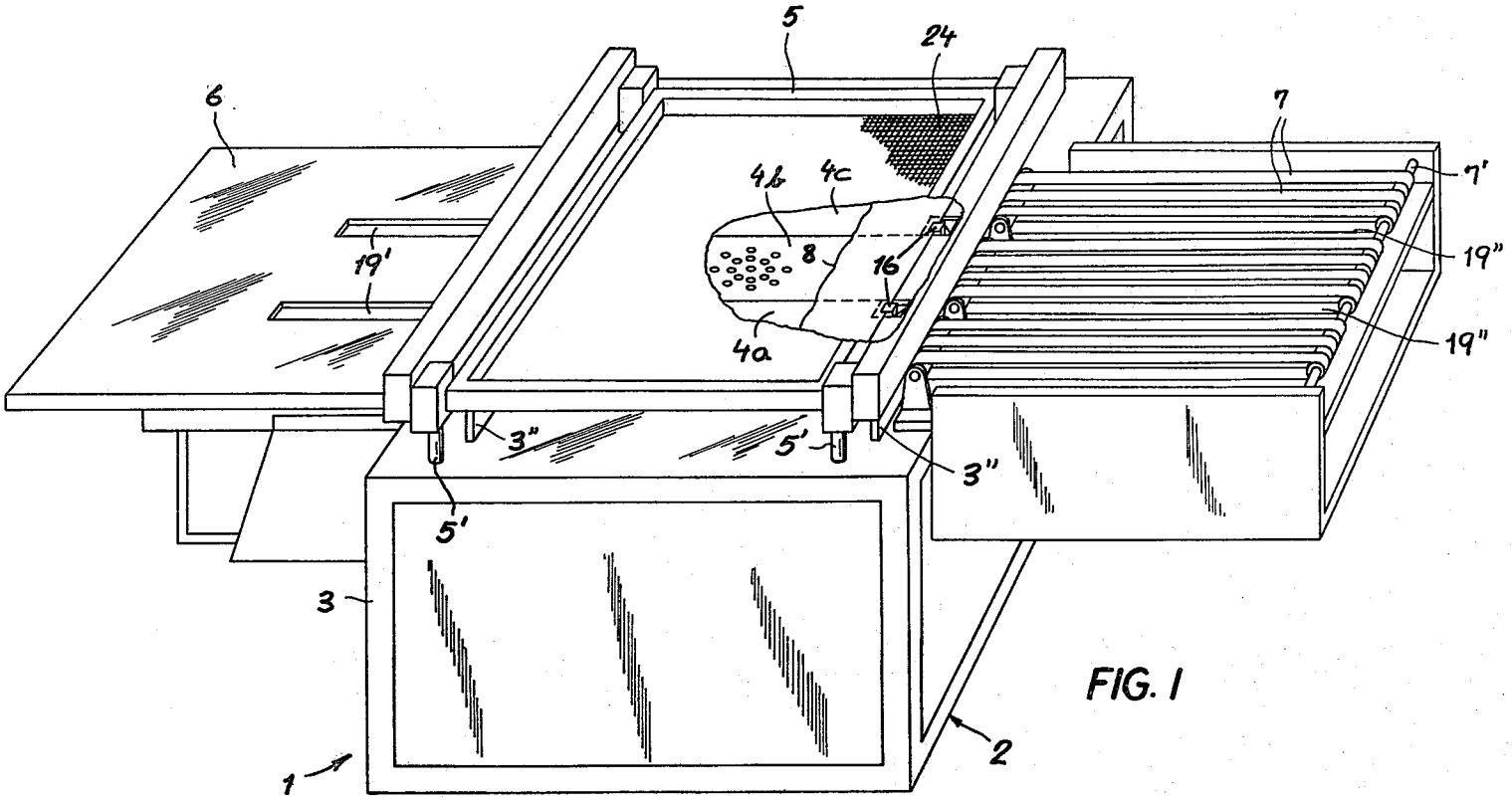
FIG. 1 is a perspective view of a screen printer according to my invention, with its printing screen in working position and partly broken away to expose an underlying tripartite bed.
Figure 2:
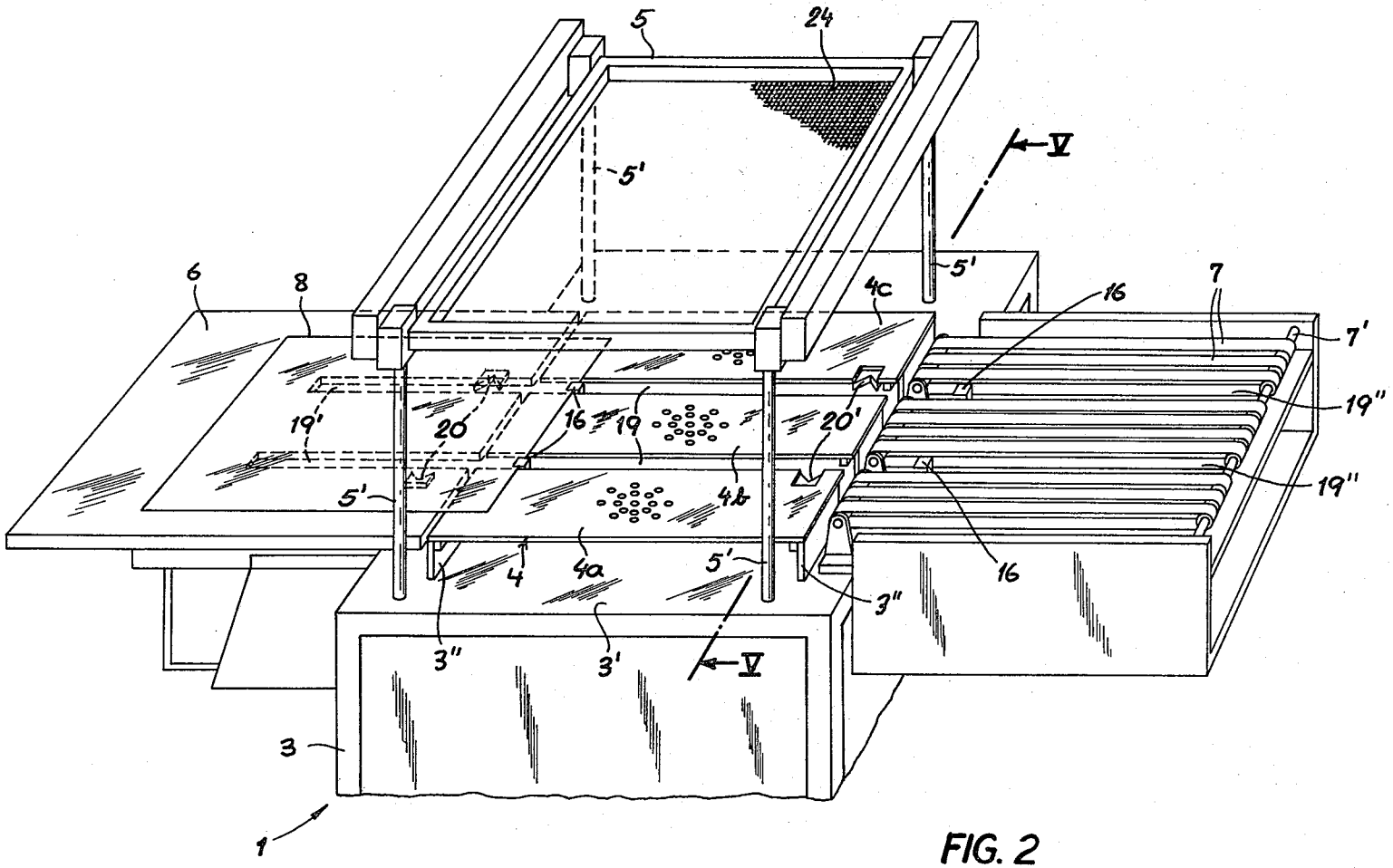
FIG. 2 is a view similar to FIG. 1, showing the screen in an exaggeratedly raised position.
Figure 3:
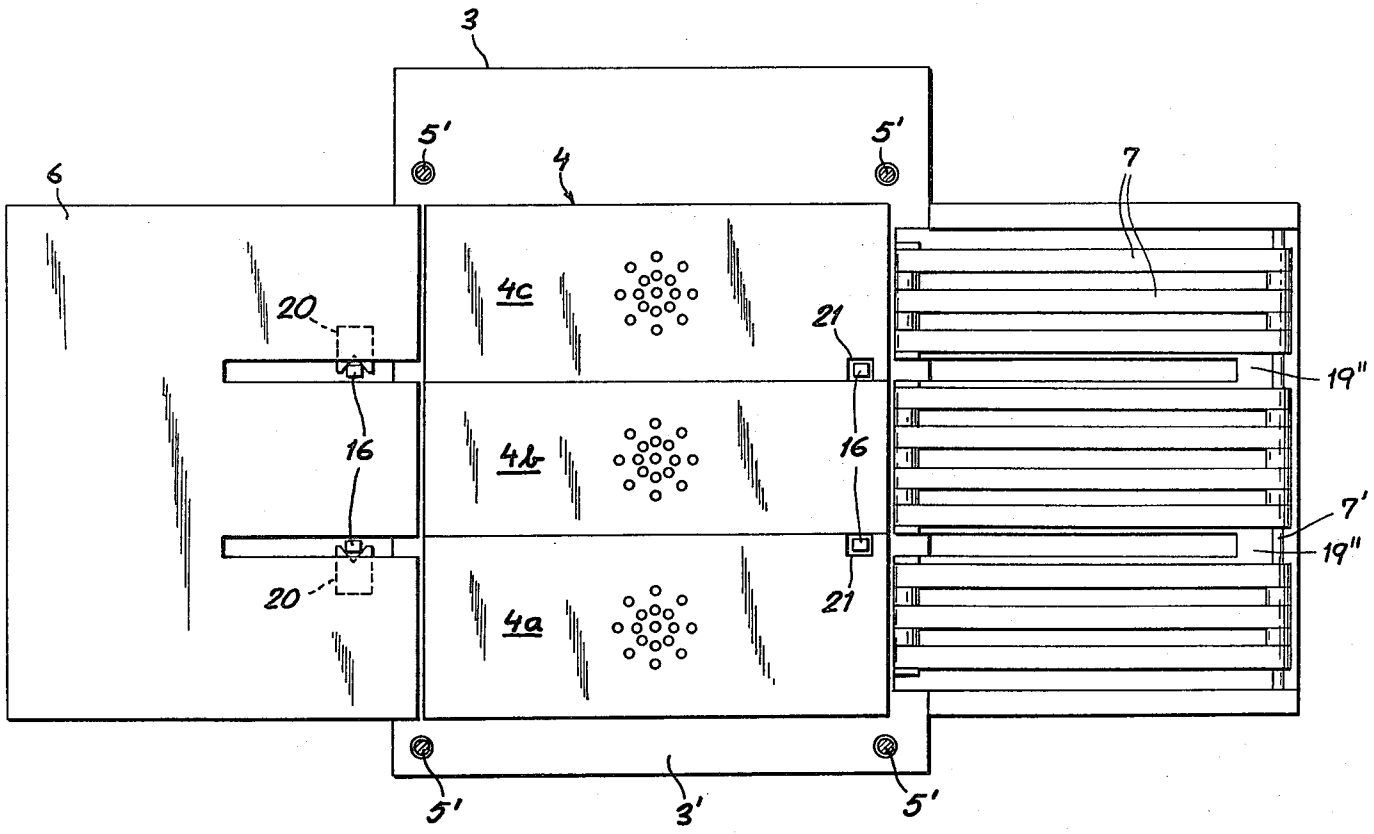
FIG. 3 is a top plan view of the printer of FIGS. 1 and 2 with its screen removed and with its bed sections in a closure position.
Figure 4:
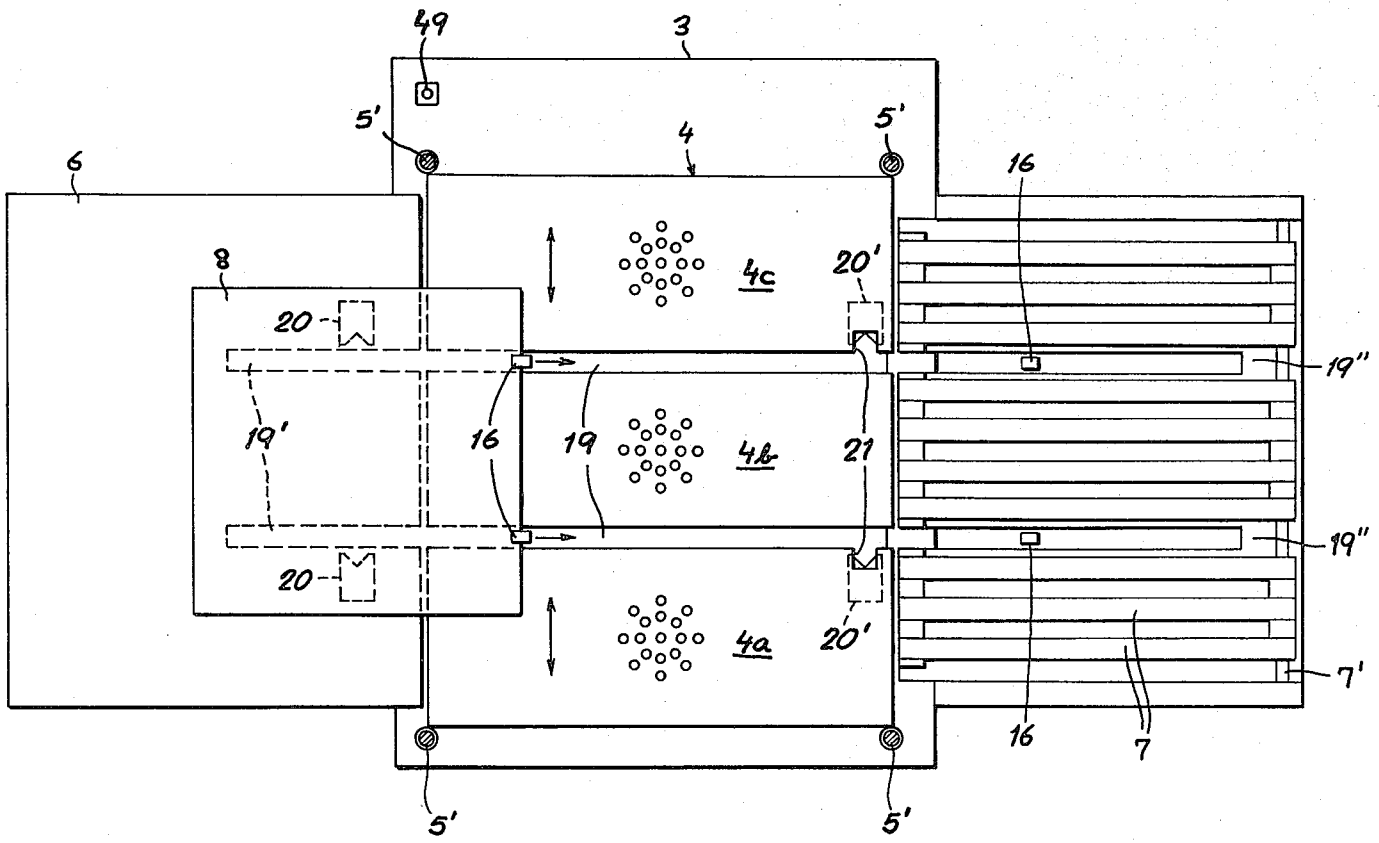
FIG. 4 is a view similar to FIG. 3 but with the bed sections separated.

A pushbutton 49, also shown in FIG. 4, serves to start the cam motor 45 in an initial position in which one pair of grippers 16 are indexed by detents 20 on loading surface 6 while another pair of grippers are lodged in the cutouts 21 of sections **4*a* and 4*c* of the unified bed 4. If a sheet 8 happens to underlie the lowered screen holder 5, the operator will then use the ink applicator 22 to imprint same with the pattern of screen 24. Next, another sheet 8 to be so imprinted is inserted into the open jaws 16''' of the grippers indexed by detents 20 whereupon the operator will push the button 49** to start a new cycle.

As shown in FIG. 8, closure of pushbutton switch 49 energizes the cam motor 45 via an armature and back contact of a relay 50. With cam 14 in its alternate position offset by 90° from the one shown in FIG. 5, the operation of motor 45 raises the link 44 and starts the outward shift of bed sections **4*a* and 4*c* along with the elevation of screen holder 5. As soon as that holder begins to lift off the bed 4, switch 40 is reclosed and shunts the pushbutton 49 which can therefore now be released. When the spreader cam 14 has reached the position of FIG. 5, its companion cam 37 closes the switch 38 to actuate the relay 50 which thereupon locks via one of its armatures and de-energizes the cam drive 45–47. Another armature of relay 50 energizes the feed motor 48 along with the solenoids of detents 20 and 20' whereby the grippers 16 engaging the new sheet 8 are advanced to their next station at detents 20' whereas the grippers formerly residing at that station, still entraining the sheet just imprinted, move out into slots 19'' of unloading surface 7 where their jaws 16''' are opened by ramps 36** just before these grippers recede beneath this surface at the end of their horizontal runs.

Through a nonillustrated transmission, feed motor 48 is also coupled with the belts of unloading surface 7 for the discharge of a printed sheet previously released thereon in the aforedescribed manner.

Figure 6:
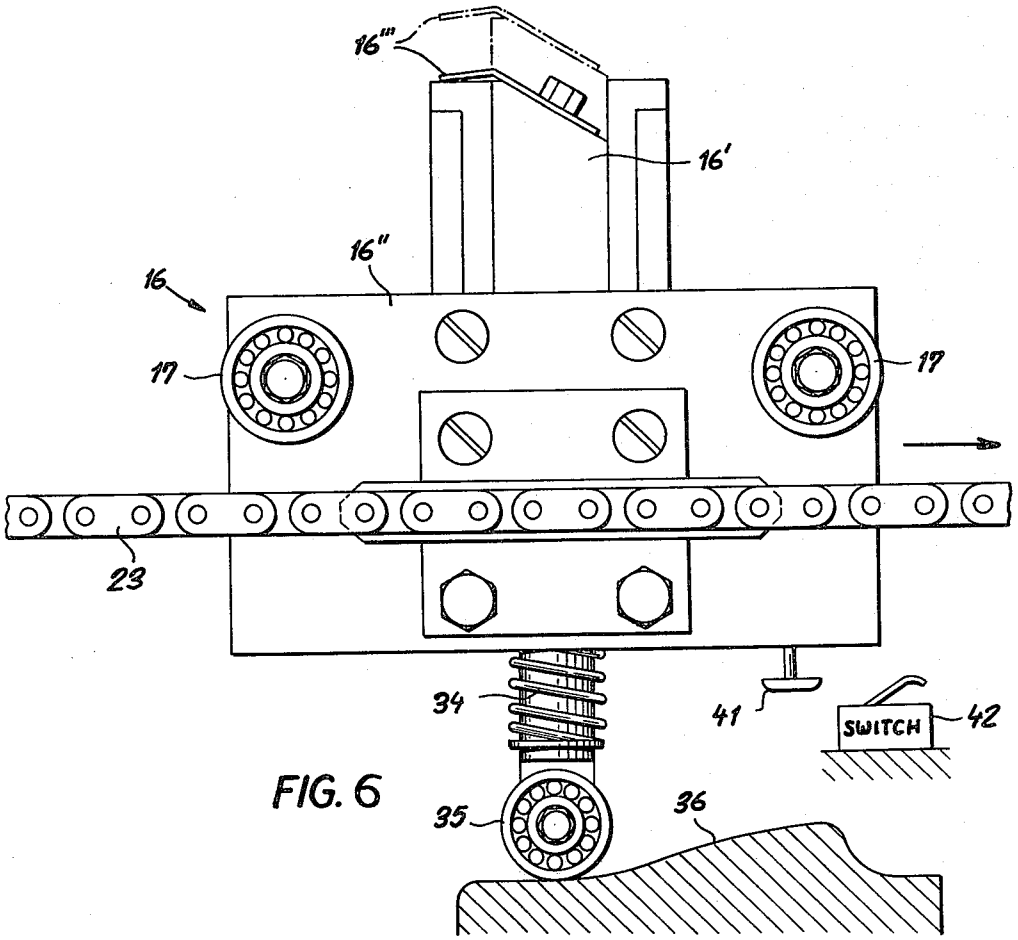
FIG. 6 is a detail view of part of a sheet-feeding mechanism in the screen printer of FIGS. 1–5, drawn to a larger scale.
Figure 7:
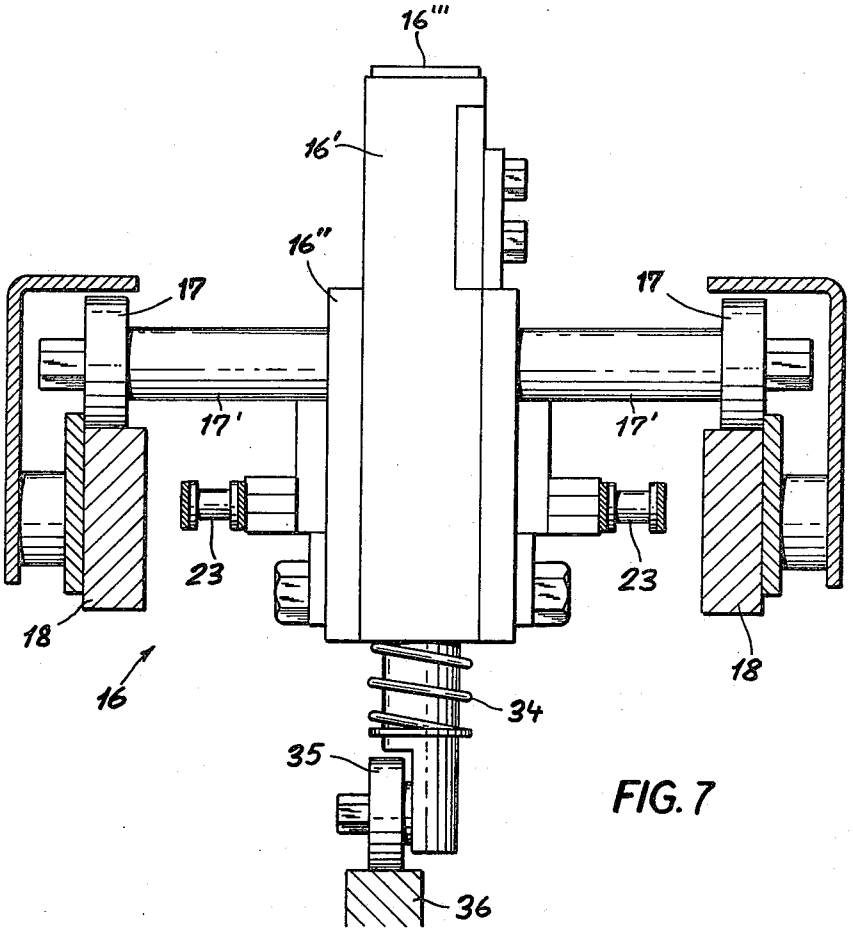
FIG. 7 is a face view of the detail illustrated in FIG. 6.

As shown in FIG. 6, at least one gripper 16 of each aligned pair carries a shoe 41 which opens a switch 42 when that gripper approaches the insertion position defined by detents 20. Switch 42, lying in the holding circuit of relay 50, then causes the release of the relay whereby motor 48 is stopped, detents 20 and 20' are enabled by the de-energization of their solenoids to engage under spring pressure the grippers now facing them, and cam motor 45 is restarted to drive the crank arm 47 through another 180° whereby cam shaft 30 returns to its previous position of bed closure and descent of screen holder 5. Upon the completion of that descent, switch 40 is reopened and arrests the cam drive 45–47. The operations just described can then be repeated.

It will be apparent that this semiautomatic system could readily be replaced by a fully automatic one, with mechanical sheet insertion from a hopper and inking of screen 24, under the control of a suitable programmer supplementing or replacing the circuitry of FIG. 8. Conversely, the several components of my improved screen printer could also be operated entirely by hand if the user observes the proper sequence of steps.

I claim:

1. A screen printer comprising:

a base forming a transport path for sheets to be imprinted;

a flat bed in said transport path divided into a plurality of relatively displaceable sections adjoining one another along boundaries parallel to the direction of sheet transport;

a screen holder overlying said bed;

operating means for alternately raising and lowering said screen holder with concurrent displacement of said sections to separate same upon a raising of said screen holder and to move same together upon a lowering of said screen holder to form a continuous sheet-supporting surface; and feed means correlated with said operating means for placing a sheet to be imprinted on said bed before each descent of said screen holder and thereafter removing the imprinted sheet, said feed means including sheet-gripping means passing substantially on the level of said bed between the separated sections thereof in a raised position of said screen holder.

2. A screen printer as defined in claim 1 wherein said transport path further includes a loading surface and an unloading surface on opposite sides of said bed, said sections being shiftable in a common horizontal plane of said loading and unloading surfaces.

3. A screen printer as defined in claim 2 wherein said loading and unloading surfaces are provided with slots for receiving said sheet-gripping means in line with the boundaries of said sections.

4. A screen printer as defined in claim 3 wherein said feed means further includes an intermittently driven conveyor in said base provided with a guide track paralleling said slots and said boundaries, said sheet-gripping means being linked with said conveyor.

5. A screen printer as defined in claim 4, further comprising indexing means on said base engageable with said sheet-gripping means for arresting same in a predetermined loading position and in a predetermined printing position upon deactivation of said conveyor.

6. A screen printer as defined in claim 1 or 5 wherein said sections include a stationary middle section and two outer sections shiftable transversely toward and away from said middle section, said sheet-gripping means comprising at least two grippers movable along respective boundaries of said middle section.

7. A screen printer as defined in claim 6 wherein said outer sections are provided with cutouts confronting said middle section for accommodating said sheet grippers in a printing position thereof upon close juxtaposition of said sections.

8. A screen printer as defined in claim 6 wherein said sections are provided with individual suction means for immobilizing a sheet on said printing surface.

* * * * *